US006526726B1

(12) United States Patent
Strand et al.

(10) Patent No.: US 6,526,726 B1
(45) Date of Patent: Mar. 4, 2003

(54) METHOD OF APPLYING A SLIDER TO A FASTENER-CARRYING PLASTIC WEB

(75) Inventors: Aaron L. Strand, Plymouth, WI (US); Alexander R. Provan, Canandaigua, NY (US); Thomas L. Coomber, Palmyra, NY (US); Toby R. Thomas, Victor, NY (US)

(73) Assignee: Pactiv Corporation, Lake Forest, IL (US)

( * ) Notice: Subject to any disclaimer, the term of this patent is extended or adjusted under 35 U.S.C. 154(b) by 65 days.

(21) Appl. No.: 09/637,037

(22) Filed: Aug. 10, 2000

(51) Int. Cl.[7] ..... B65B 61/18

(52) U.S. Cl. ..... 53/412; 53/133.4; 29/768; 493/214; 493/927; 156/66

(58) Field of Search ..... 53/133.4, 139.2, 53/412; 29/408, 409, 410, 768; 156/66; 383/64; 493/213, 214, 927

(56) References Cited

U.S. PATENT DOCUMENTS

| | | | | |
|---|---|---|---|---|
| 3,381,592 | A | 5/1968 | Ravel | |
| 3,473,589 | A | 10/1969 | Gotz | |
| 3,532,571 | A | 10/1970 | Ausnit | |
| RE27,174 | E | 9/1971 | Ausnit | |
| 3,608,439 | A | 9/1971 | Ausnit | |
| 3,613,524 | A | 10/1971 | Behr et al. | |
| 3,701,191 | A | 10/1972 | Laguerre | |
| 3,701,192 | A | 10/1972 | Laguerre | |
| 3,785,111 | A | 1/1974 | Pike | |
| 3,839,128 | A | 10/1974 | Arai | |
| 3,948,705 | A | 4/1976 | Ausnit | |
| 3,988,184 | A | * 10/1976 | Howard | 156/66 |
| 4,094,729 | A | 6/1978 | Boccia | |
| 4,196,030 | A | 4/1980 | Ausnit | |
| 4,240,241 | A | 12/1980 | Sanborn, Jr. | |
| 4,246,288 | A | 1/1981 | Sanborn, Jr. | |
| 4,277,241 | A | 7/1981 | Schulze | |
| 4,341,575 | A | 7/1982 | Herz | |
| 4,355,494 | A | 10/1982 | Tilman | |
| 4,372,793 | A | 2/1983 | Herz | |
| 4,415,386 | A | 11/1983 | Ferrell et al. | |
| 4,430,070 | A | 2/1984 | Ausnit | |
| 4,437,293 | A | 3/1984 | Sanborn, Jr. | |
| 4,517,788 | A | 5/1985 | Scheffers | |
| 4,528,224 | A | 7/1985 | Ausnit | |
| 4,563,319 | A | 1/1986 | Ausnit et al. | |
| 4,581,006 | A | 4/1986 | Hugues et al. | |
| 4,582,549 | A | 4/1986 | Ferrell | |
| 4,601,694 | A | 7/1986 | Ausnit | |
| 4,617,683 | A | 10/1986 | Christoff | |
| 4,651,504 | A | 3/1987 | Bentsen | |
| 4,655,862 | A | 4/1987 | Christoff et al. | |
| 4,663,915 | A | 5/1987 | Van Erden et al. | |
| 4,666,536 | A | 5/1987 | Van Erden et al. | |
| 4,673,383 | A | 6/1987 | Bentsen | |

(List continued on next page.)

FOREIGN PATENT DOCUMENTS

| | | |
|---|---|---|
| EP | 0 939 034 | 9/1999 |
| EP | 0 978 450 | 2/2000 |
| EP | 1 026 077 A2 | 8/2000 |
| GB | 2 085 519 | 4/1982 |
| WO | 99/24325 | 5/1999 |

*Primary Examiner*—John Sipos
(74) *Attorney, Agent, or Firm*—Jenkens & Gilchrist

(57) ABSTRACT

A method of applying a slider to a fastener-carrying web of plastic film. The fastener includes interlockable profiles and fins depending from the respective profiles. One of the fins is attached to the web of plastic film such that the profiles are immediately adjacent to the web. The fastener is folded away from the web about the attached fin such that the profiles and proximate portions of the fins are oriented at an angle, preferably about 90 degrees, relative the web. Because the profiles and proximate fin portions are oriented at an angle relative to the web, they can be easily accessed and controlled for applying the slider to the profiles and performing other fastener-related operations.

29 Claims, 3 Drawing Sheets

U.S. PATENT DOCUMENTS 4,691,372 A 9/1987 Van Erden
4,703,518 A 10/1987 Ausnit
4,709,398 A 11/1987 Ausnit
4,709,533 A 12/1987 Ausnit
4,710,157 A 12/1987 Posey
4,782,951 A 11/1988 Griesbach et al.
4,787,880 A 11/1988 Ausnit
4,790,126 A 12/1988 Boeckmann
4,807,300 A 2/1989 Ausnit et al.
4,812,074 A 3/1989 Ausnit et al.
4,840,012 A 6/1989 Boeckmann
4,840,611 A 6/1989 Van Erden et al.
4,844,759 A 7/1989 Boeckmann
4,850,178 A 7/1989 Ausnit
4,876,842 A 10/1989 Ausnit
4,878,987 A 11/1989 Ven Erden
4,892,414 A 1/1990 Ausnit
4,892,512 A 1/1990 Branson
4,894,975 A 1/1990 Ausnit
4,909,017 A 3/1990 McMahon et al.
4,924,655 A 5/1990 Posey
4,925,318 A 5/1990 Sorensen
4,929,225 A 5/1990 Ausnit et al.
4,941,307 A 7/1990 Wojcik
4,969,309 A 11/1990 Schwarz et al.
4,974,395 A 12/1990 McMahon
4,993,212 A 2/1991 Veoukas
5,005,707 A 4/1991 Hustad et al.
5,014,498 A 5/1991 McMahon
5,027,584 A 7/1991 McMahon et al.
5,036,643 A 8/1991 Bodolay
5,042,224 A 8/1991 McMahon
5,046,300 A 9/1991 Custer et al.
5,063,639 A 11/1991 Boeckmann et al.
5,072,571 A 12/1991 Boeckmann
5,085,031 A 2/1992 McDonald
5,092,831 A 3/1992 James et al.
5,096,516 A 3/1992 McDonald et al.
5,105,603 A 4/1992 Natterer
5,107,658 A 4/1992 Hustad et al.
5,111,643 A 5/1992 Hobock
5,116,301 A 5/1992 Robinson et al.
5,127,208 A 7/1992 Custer et al.
5,147,272 A 9/1992 Richison et al.
5,161,286 A 11/1992 Herrington, Jr. et al. ..... 24/387
5,179,816 A 1/1993 Wojnicki
5,188,461 A 2/1993 Sorensen
5,211,482 A 5/1993 Tilman
5,247,781 A 9/1993 Runge
5,254,073 A 10/1993 Richison et al.
5,259,904 A 11/1993 Ausnit
5,273,511 A 12/1993 Boeckmann
5,322,579 A 6/1994 Van Erden
5,334,127 A 8/1994 Bruno et al.
5,383,989 A 1/1995 McMahon
5,400,565 A 3/1995 Terminella et al.
5,400,568 A 3/1995 Kanemitsu et al.
5,405,629 A 4/1995 Marnocha et al.
5,412,924 A 5/1995 Ausnit
5,415,904 A 5/1995 Takubo et al.
5,425,216 A 6/1995 Ausnit
5,425,825 A 6/1995 Rasko et al.
5,431,760 A 7/1995 Donovan ..... 156/66
5,435,864 A 7/1995 Machacek et al.
5,442,837 A 8/1995 Morgan ..... 24/400
5,470,156 A 11/1995 May
5,489,252 A 2/1996 May
5,492,411 A 2/1996 May
5,505,037 A 4/1996 Terminella et al.
5,509,735 A 4/1996 May
5,511,884 A 4/1996 Bruno et al.
5,519,982 A 5/1996 Herber et al.
5,525,363 A 6/1996 Herber et al.
5,542,902 A 8/1996 Richison et al.
5,551,127 A 9/1996 May
5,551,208 A 9/1996 Van Erden
5,557,907 A 9/1996 Malin et al.
5,558,613 A 9/1996 Tilman et al.
5,561,966 A 10/1996 English
5,564,259 A 10/1996 Stolmeier
5,573,614 A 11/1996 Tilman et al.
5,592,802 A 1/1997 Malin et al.
5,613,934 A 3/1997 May
5,628,566 A 5/1997 Schreiter
5,647,671 A 7/1997 May
5,669,715 A 9/1997 Dobreski et al.
5,682,730 A 11/1997 Dobreski
5,725,312 A 3/1998 May
5,782,733 A 7/1998 Yeager
5,788,378 A 8/1998 Thomas
5,823,933 A 10/1998 Yeager
5,833,791 A 11/1998 Bryniarski et al.
5,906,438 A 5/1999 Laudenberg
5,956,924 A 9/1999 Thieman
6,044,621 A 4/2000 Malin et al.
6,138,436 A 10/2000 Malin et al.
6,138,439 A 10/2000 McMahon et al.
6,148,588 A * 11/2000 Thomas et al. ..... 53/133.4

* cited by examiner

METHOD OF APPLYING A SLIDER TO A FASTENER-CARRYING PLASTIC WEB

REFERENCE TO RELATED APPLICATIONS

The present application is being filed concurrently with U.S. patent application Ser. No. 09/636,244 entitled "Injection-Molded End Stop for a Slider-Operated Fastener," U.S. patent application Ser. No. 09/636,421 entitled "Slider-Operated Fastener With Spaced Notches and Associated Preseals," U.S. patent application Ser. No. 09/635,451 entitled "Method and Apparatus for Guiding a Fastener in a Bag Making Machine," and U.S. patent application Ser. No. 09/637,038 entitled "Method and Apparatus for Making Reclosable Plastic Bags Using a Pre-applied Slider-Operated Fastener," all of which are incorporated herein by reference in their entireties.

FIELD OF THE INVENTION

The present invention generally relates to reclosable plastic bags and, more particularly, to a method of applying a slider to a fastener-carrying web of plastic film.

BACKGROUND OF THE INVENTION

In one method of making slider-operated reclosable plastic bags, a continuous fastener is sealed to opposing longitudinal edges of a folded web of thermoplastic film moving in a longitudinal direction. To form individual bags, the folded web is sealed at bag-width distances apart along side seals that are generally transverse to the direction of web movement. To facilitate opening and closing the fastener, sliders are applied to the fastener at bag-width distances apart either just before or just after the side seals are formed in the folded web. In another method of making slider-operated reclosable plastic bags, the sliders are applied to the fastener prior to attaching the fastener to the moving web. In each of the above-noted methods, the fastener is positioned relative to the moving web such that the fastener can be easily accessed and controlled for installing the sliders.

To make slider-operated reclosable plastic bags in which the fastener is buried within a header or pocket near the top of the bags, the fastener is initially sealed near a center, rather than an edge, of a web of thermoplastic film moving in a longitudinal direction. The moving web is then folded in half along a longitudinal fold with the fastener inside the web and proximate the fold. To form individual bags, the folded web is sealed at bag-width distances apart along side seals that are generally transverse to the direction of web movement. Unless sliders are applied to the fastener prior to attaching the fastener to the moving web, it is difficult to access and control the fastener for installing sliders and performing other fastener-related operations after the fastener is attached near the center of the moving web. Because the fastener is parallel and close to the same plane as the web, gaining access to the fastener for applying sliders becomes limited by the close proximity of the fastener to the web.

SUMMARY OF THE INVENTION

Accordingly, an object of the present invention is to provide a method of applying a slider to a fastener-carrying web of plastic film that allows the fastener to be easily accessed and controlled for installing the slider and performing other fastener-related operations after the fastener is attached to the web.

This and other objects are realized by the following method of applying a slider to a fastener-carrying web of plastic film. The fastener includes interlockable profiles and fins depending from the respective profiles. One of the fins is attached to the web of plastic film such that the profiles are immediately adjacent to the web. The fastener is folded away from the web about the attached fin such that the profiles and proximate portions of the fins are oriented at an angle, preferably about 90 degrees, relative the web. Because the profiles and proximate fin portions are oriented at an angle relative to the web, they can be easily accessed and controlled for applying the slider to the profiles and performing other fastener-related operations.

BRIEF DESCRIPTION OF THE DRAWINGS

Other objects and advantages of the invention will become apparent upon reading the following detailed description and upon reference to the drawings in which.

Figure 1:
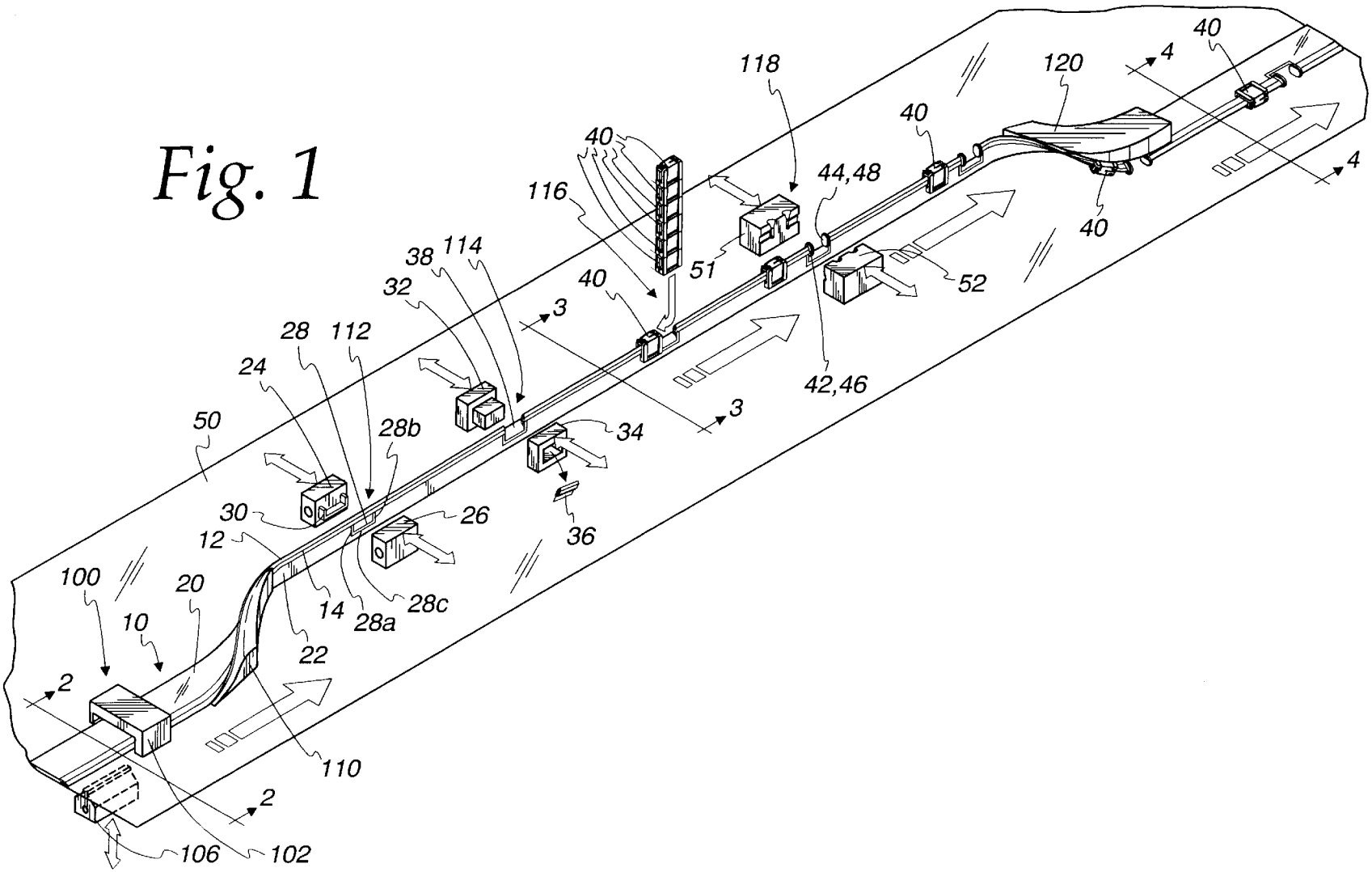
FIG. 1 depicts a method of making a slider-operated fastener.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATED EMBODIMENTS

Turning to the drawings, FIG. 1 depicts a method of making a slider-operated fastener for use in reclosable plastic bags. In the method, there is provided a continuous fastener 10 including first and second opposing tracks 12 and 14. The tracks 12 and 14 include respective first and second interlocking profiles 16 and 18 and respective first and second fins 20 and 22 extending downward from the respective profiles 16 and 18. The profile 16 preferably includes a rib, and the profile 18 preferably includes a groove for receiving the rib. Further details concerning the construction of the profiles 16 and 18 may be obtained from U.S. Pat. No. 5,007,143 to Herrington, which is incorporated herein by reference in its entirety. The fastener 10 may be unwound from a spool or the like.

Figure 2:
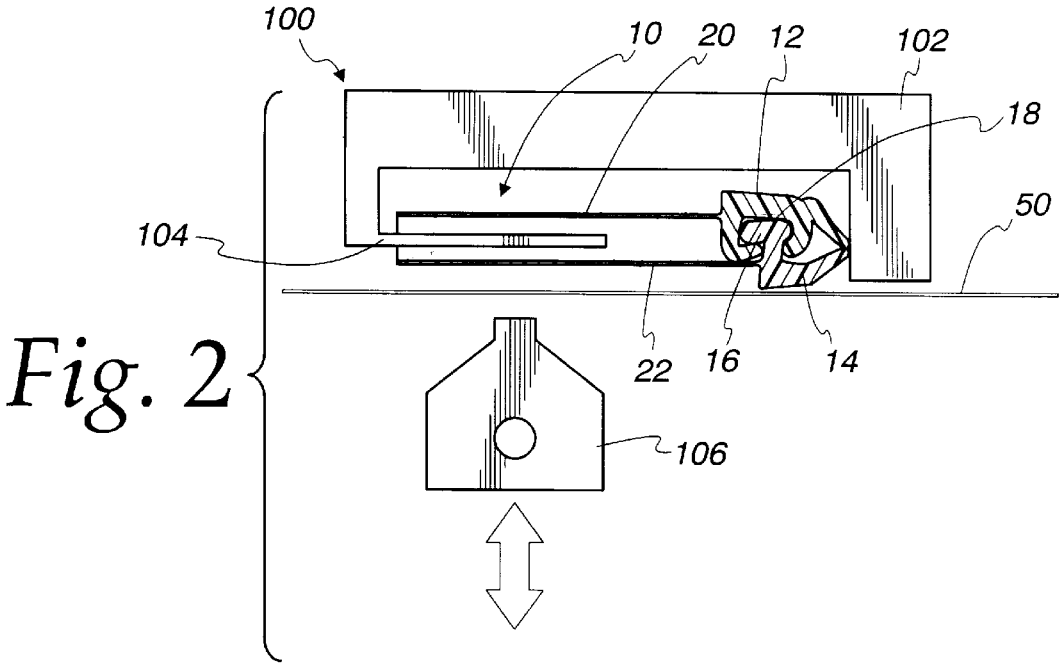
FIG. 2 is a view taken along line 2—2 in FIG. 1.

The fastener 10 is conveyed along a web of plastic film 50 to a fin seal station 100 (FIGS. 1 and 2). The fin seal station 100 includes a guide 102 with a splitter 104 that extends between the fins 20 and 22. The fin seal station 100 also includes a heated tack or seal bar 106. The bar 106 is reciprocated into and away from the fin 22 and the splitter 104 while the fastener 10 and the web 50 are temporarily stopped. When this occurs, the fin 22 is lightly tacked or sealed to the web 50 at a seal line 108 (FIGS. 3 and 4).

Figure 3:
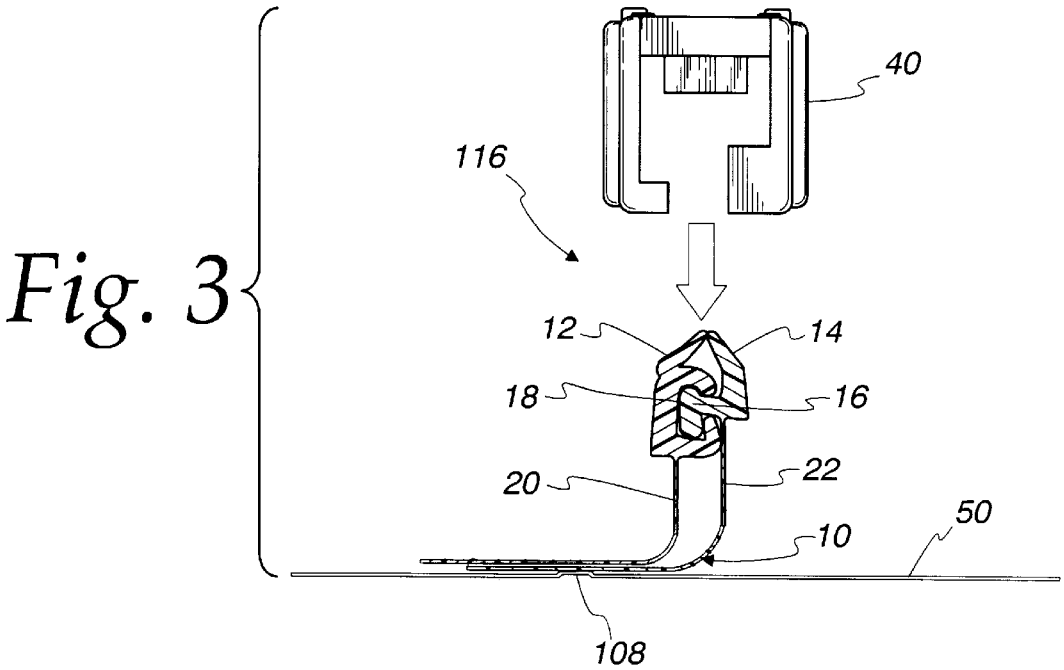
FIG. 3 is a view taken along line 3—3 in FIG. 1.
Figure 4:
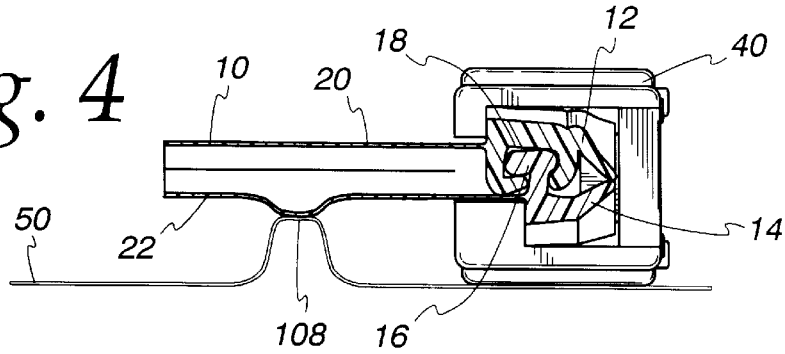
FIG. 4 is a view taken along line 4—4 in FIG. 1.

As the web 50 and fastener 10 are advanced past the fin seal station 100 the fastener 10 engages a plow or ramp 110 that folds the fastener 10 about the seal line 108 to an orientation approximately perpendicular to the web 50 (see, for example, FIG. 3). Rollers, guides and the like (not shown) may be located downstream from the plow 110 to assist in maintaining the fastener 10 in this orientation perpendicular to the web.

The fastener-carrying web 50 is conveyed by to a preseal station 112. The preseal station includes a pair of reciprocating seal bars 24 and 26. Either both of the seal bars 24 and 26 move back and forth between open and closed positions, or one of the seal bars is stationary while the other seal bar moves back and forth. At least one seal bar is heated. The other bar may be heated as well, or may simply serve as a compliant backing against which the heated seal bar applies pressure and temperature when the seal bars 24 and 26 are brought together. The temperature, pressure, and dwell time of the seal bars 24 and 26 are properly adjusted to allow the seal bars 24 and 26 to impart a U-shaped preseal 28. While the web 50 is temporarily stopped at the preseal station, the fins 20 and 22 are sealed to each other along the U-shaped preseal 28. The preseal 28 includes a pair of opposing sides 28*a*, 28*b* and a bottom 28*c* bridging the opposing sides. The opposing sides 28*a*, 28*b* are generally located along an upper portion of the fins 20 and 22 and extend downward from the interlocked profiles 16 and 18. The bottom 28*c* is located along a lower portion of the fins 20 and 22. The seal bar 24 has a U-shaped projection 30 corresponding to the shape of the preseal 28. Although the preseal 28 is illustrated as being generally U-shaped, the area between the sides 28*a*, 28*b* of the preseal 28 may be sealed as well so that the preseal 28 appears like a solid rectangle rectangle, or a bracket shape to minimize the heat imparted on the lower portion of the fins 20 and 22 causing stretching, shrinkage and wrinkling of fins. The preseal 28 preferably does not extend into the profiles 16 and 18 due to the technique for installing sliders on the fastener 10 later in the manufacturing process.

After forming the preseal 28, the fastener-carrying web 50 is conveyed to a notching station 114. The notching station 114 includes a pair of reciprocating cutters 32 and 34. Either both of the cutters 32 and 34 move back and forth between open and closed positions, or one of the cutters is stationary while the other cutter moves back and forth. The cutter 32 forms a rectangular projection, while the cutter 34 forms a rectangular hole for receiving the projection. Other shapes may be used as well. The web 50 is temporarily stopped at the notching station with the preseal 28 aligned between the separated cutters 32 and 34. While the web 50 is stopped, the cutters 32 and 34 are brought together such that the projection of the cutter 32 punches a rectangular section 36 through the hole of the cutter 34, thereby leaving a U-shaped notch 38 in the fastener 10. Prior to being punched out, the section 36 is disposed between the opposing sides 28*a*, 28*b* of the preseal 28 and above the bottom 28*c* of the preseal 28. Therefore, the preseal 28 generally encompasses the notch 38 and defines a periphery thereof such that the preseal provides a leak-resistant barrier to entry into an interior of the fastener 10 between the fins 20 and 22 via the notch 38. As discussed below, the leak-resistant barrier effectively minimizes leaks in the reclosable plastic bags ultimately formed by the manufacturing process.

After forming the notch 38, the fastener-carrying web 50 is conveyed to a slider insertion station 116 (FIGS. 1 and 3). While the web 50 is temporarily stopped at the slider insertion station 116, a slider 40 from a source of multiple sliders is positioned within the notch 38. Further details concerning the source of multiple sliders may be obtained from U.S. patent application Ser. No. 09/307,893 entitled "Assembly and Accumulation of Sliders for Profiled Zippers", filed May 10, 1999, and incorporated herein by reference in its entirety. The slider 40 is then threaded onto the fastener 10 in response to relative movement of the slider 40 and the fastener 10. Further details concerning the equipment for installing the slider 40 onto the fastener 10 via the notch 38 may be obtained from U.S. patent application Ser. No. 09/307,937 entitled "Zipper and Zipper Arrangements and Methods of Manufacturing the Same", filed May 10, 1999, and incorporated herein by reference in its entirety.

After installing the slider 40 onto the fastener 10, the fastener-carrying web 50 is conveyed to an end stop applicator 118. The end stop applicator 118 applies terminations or end stops 42 and 44 to the respective fastener ends 46 and 48 on opposite sides of the notch 38. In the plastic bags ultimately formed by the manufacturing process, the end stop 42 will be located at the fastener end 46 of one bag, while the end stop 44 will be located at the fastener end 48 of the adjacent bag. The end stops perform three primary functions: (1) preventing the slider 40 from going past the ends of the fastener, (2) holding the profiles together to resist stresses applied to the profiles during normal use of the plastic bag, and (3) minimizing leakage from inside of the plastic bag out through the fastener ends.

In one embodiment, the end stop applicator 118 includes a pair of chilled, reciprocating molds 51 and 52. Either both of the molds 51 and 52 move back and forth between open and closed positions, or one of the molds is stationary while the other mold moves back and forth. While the web 50 is temporarily stopped, the molds 51 and 52 close around the fastener ends 46 and 48. A predetermined amount of melted/softened plastic material is then forced around and between the profiles 16 and 18 at the fastener ends 46 and 48 by a conventional back pressure device (not shown) coupled to a supply tube. The molds 51 and 52 form channels for receiving the plastic material and guiding it to the fastener ends 46 and 48. Further details concerning the injection-molded end stops 42 and 44 and the method of making the same may be obtained from U.S. patent application Ser. No. 09/636,244 entitled "Injection-Molded End Stop for a Slider-Operated Fastener", filed concurrently herewith, and incorporated herein by reference in its entirety.

Instead of applying injection-molded end stops, other types of end stops may be applied to the fastener ends 46 and 48, including those disclosed in U.S. Pat. Nos. 5,924,173, 5,833,791, 5,482,375, 5,448,807, 5,442,837, 5,405,478, 5,161,286, 5,131,121, 5,088,971, and 5,067,208, which are incorporated herein by reference in their entireties. In U.S. Pat. No. 5,067,208, for example, each end stop is in the form of a fairly rigid strap/clip that wraps over the top of the fastener. One end of the strap is provided with a rivet-like member that penetrates through the fastener fins and into a cooperating opening at the other end of the strap.

While the fastener-carrying web 50 is temporarily stopped in the method depicted in FIG. 1, the various stations simultaneously perform their respective functions on different parts of the continuous fastener 10 spaced approximately at bag-width distances apart. Therefore, as the preseal station 112 forms a new preseal 28, (1) the notching station 114 forms a new notch 38 within a previously formed preseal, (2) the slider insertion station 116 installs a slider 40 via a previously formed notch, and (3) the end stop applicator 118 applies new end stops 42 and 44 proximate a previously installed slider. After each of the stations has completed its respective function on the stopped fastener 10, movement of the web 50 is resumed. The web 50 is moved for approximately a bag-width distance so that the next station can perform its respective function. The preseals 28 are advantageous in that they allow the fastener 10 to be controlled during such downstream operations as notch formation, slider installation, and end stop installation and when the fastener 10 is tensioned by various rollers in the bag making machine. The preseals 28 keep the interlocked profiles 16 and 18 together and prevent them from moving longitudinally relative to each other. In addition, by folding the fastener 10 away from the web 50, the fastener 10 can be easily accessed and controlled for the presealing, notching, slider installing and end stop installing operations.

After the end stop application 118, the fastener 10 is folded down onto the web 50 by a second plow or ramp 120 (FIGS. 1 and 4). The fastener 10 and web 50 are then ready for being formed into individual bags with reclosable fasteners.

Figure 5:
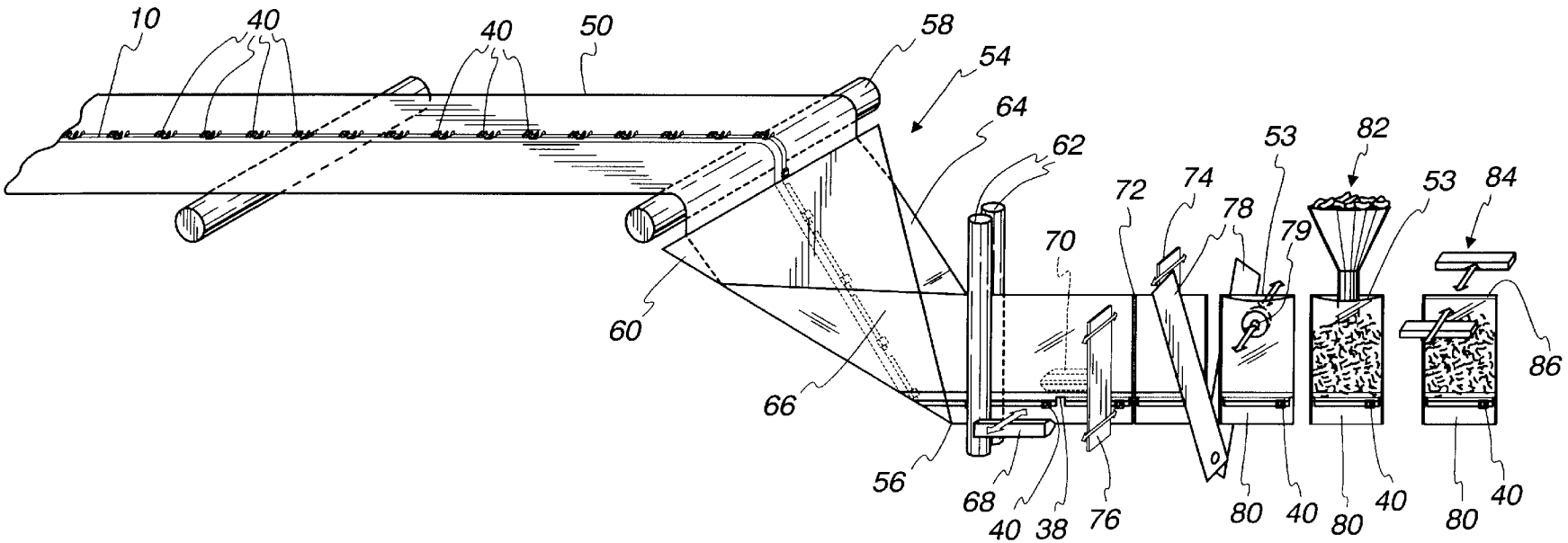
FIG. 5 depicts a method of forming, filling and sealing reclosable plastic bags employing the slider operated fastener illustrated in FIG. 1.

The fastener-carrying web 50 is conveyed to a folding station 54 (FIG. 5). At the folding station 54, the web 50 is folded in half with the fastener 10 inside the web 50 and proximate the fold 56. To fold the web 50, the web 50 is conveyed over a horizontal roller 58, under a triangular folding board 60, and then between a pair of closely spaced vertical rollers 62. The folded web 50 includes a pair of overlapping panels 64 and 66 joined along the fold 56. Other embodiments could include the fastener 10 inside the web opposite the fold at the web panel edges. For exposed zipper, the fastener would be sealed to the web proximate to the top edge of the web.

After folding the web 50, the fastener fins 20 and 22 are permanently sealed to the respective web panels 66 and 64 by respective seal bars 68 and 70. The seal bars 68 and 70 are sufficiently wide that they generate the fin seals across the entire width of a bag produced by the method in FIG. 5. Either both of the seal bars 68 and 70 move back and forth between open and closed positions, or one of the seal bars is stationary while the other seal bar moves back and forth. The fastener-carrying web 50 is temporarily stopped while the seal bars are brought together to seal the fastener 10 to the web 50. Both of the seal bars 68 and 70 are preferably heated. The temperature, pressure, and dwell time of the seal bars 68 and 70 are properly adjusted to allow the seal bars 68 and 70 to generate the permanent fin seals. In an alternative embodiment, the seal bars 68 and 70 are replaced with a static heat sealing mechanism such as a pair of hot air blowers that blow heated air onto the respective fastener fins.

After sealing the fins 20 and 22 to the respective web panels 66 and 64, the web panels 64 and 66 are sealed to each other along a side seal 72 by a pair of reciprocating seal bars 74 and 76. The side seal 72 is transverse to a direction of movement of the folded web 50 and is aligned with a center of the notch 38 (and preseal 28). Also, the side seal 72 extends from the folded bottom 56 to an open top 53 of the folded web 50. Either both of the seal bars 74 and 76 move back and forth between open and closed positions, or one of the seal bars is stationary while the other seal bar moves back and forth. The folded web 50 is temporarily stopped while the seal bars are brought together to seal the web panels 64 and 66 to each other. At least one seal bar is heated. The other bar may be heated as well, or may simply serve as a compliant backing against which the heated seal bar applies pressure and temperature when the seal bars 74 and 76 are brought together. The temperature, pressure, and dwell time of the seal bars 74 and 76 are properly adjusted to allow the seal bars 74 and 76 to generate the side seal 72.

After generating the side seal 72, the folded web 50 is conveyed to a cutter 78 for separating the folded web 50 into individual plastic bags. While the folded web 50 is temporarily stopped, the cutter 78 cuts the folded web 50 along a center of the side seal 72 to produce the individual plastic bag 80. The plastic bag 80 is opened with an opening device 79 and filled with a product through its open top 53 at a filling station 82. Finally, the open top 53 is sealed by a heat sealing mechanism 84 to form final seal 86. The end result is a filled and sealed bag 80 ready for shipment to a customer such as a grocery store or convenience store.

While the web 50 is temporarily stopped in the method depicted in FIG. 2, the various stations simultaneously perform their respective functions on different parts of the continuous web 50. For example, when the web 50 is stopped, (1) the fastener fins 20 and 22 can be permanently sealed to the respective web panels 64 and 66 by respective seal bars 68 and 70, (2) the web panels 64 and 66 carrying previously sealed fastener fin sections can be sealed to each other along a side seal 72 by the seal bars 74 and 76, and (3) the folded web 50 can be cut along a previously generated side seal. After each of the stations has completed its respective function on the stopped web 50, movement of the web 50 is resumed.

While the present invention has been described with reference to one or more particular embodiments, those skilled in the art will recognize that many changes may be made thereto without departing from the spirit and scope of the present invention. For example, the fastener may be folded prior to being attached to the web. The fastener profiles are folded relative to distal portions of the fastener fins, and then one of the distal fin portions is attached to the web. Also, the equipment used in the fastener and bag manufacturing processes may be modified so that the processes are entirely continuous with no temporary stoppages in the movement of the fastener or bag making web. Thus, any and all of the unit operations may be performed (1) during a continuous web motion such as a rotary or continuous draw machine or (2) during the web index of an intermittent motion machine. Each of these embodiments and obvious variations thereof is contemplated as falling within the spirit and scope of the claimed invention, which is set forth in the following claims.

What is claimed is:

1. A method of applying a slider to a fastener-carrying web of plastic film, comprising:

providing said web of plastic film;

providing a fastener including first and second opposing tracks, said first and second tracks including respective first and second interlocking profiles and respective first and second fins extending from said respective first and second profiles;

sealing one of said first and second fins to said web of plastic film;

folding said fastener relative to said web of plastic film wherein said fastener is at an angle to said web of plastic film; and mounting the slider to said fastener.

2. The method of claim 1 further including sealing said first and second fins to each other at spaced preseals prior to said mounting said slider.

3. The method of claim 1 further including forming a notch in said first and second interlocking profiles prior to said mounting said slider.

4. The method of claim 1 further including sealing said first and second fins at spaced preseals, and forming a notch in each said respective preseal and in said first and second interlocking profiles prior to said mounting said slider onto said zipper.

5. The method of claim 1 further including folding said slider-carrying fastener onto said web of plastic film.

6. The method of claim 1 further including folding said web of plastic film to form two sides of a bag, sealing the other of said first and second fins to said web of plastic film, forming side seals in said web of plastic film for individual bags, and separating said web of plastic film into individual bags.

7. The method of claim 1 further including forming a tube out of said web of plastic film to form two sides of a bag, sealing the other of said first and second fins to said web of plastic film, forming side seals in said web of plastic film for individual bags, and separating said web of plastic film into individual bags.

8. A method of applying sliders to a fastener-carrying web of plastic film, comprising:

advancing said web of plastic film along a predetermined path;

providing a fastener including first and second opposing tracks with respective first and second respective interlocking profiles and respective first and second fins depending from said respective first and second profiles;

sealing one of said fins to said web of plastic film;

folding said fastener away from said web of plastic film about said sealed fin;

mounting sliders on said fastener at predetermined locations; and folding said slider-carrying fastener onto said web of plastic film.

9. The method of claim 8 further including sealing said first and second fins at said predetermined locations.

10. The method of claim 8 further including forming at said predetermined locations a notch in said first and second respective interlocking profiles and said first and second fins prior to said mounting said sliders.

11. The method of claim 8 further including folding said web of plastic film in half to form two sides of said bags.

12. The method of claim 8 further including folding said web of plastic film in half to form two sides of said bags, and forming side seals for said bags in said web of plastic film.

13. The method of claim 8, further including folding said web of plastic film in half to form two sides of said bags, forming first and second fin seals to said two sides of said bags, forming side seals for said bags in said web of plastic film.

14. The method of claim 8 further including folding said web of plastic film in half to form two sides of said bags, forming side seals for said bags in said web of plastic film, and cutting said web of plastic film along said side seals to separate said bags.

15. The method of claim 8 further including folding said web of plastic film in half to form two sides of said bags, forming first and second fin seals to said two sides of said bags, forming side seals for said bags in said web of plastic film, and cutting said web of plastic film along said side seals to separate said bags.

16. A method of making plastic bags that have a fastener opened and closed by a slider, comprising:

advancing a web of plastic film along a path;

advancing a fastener along said path adjacent said web of plastic film, said fastener including first and second tracks, said first and second tracks including respective first and second interlocking profiles and respective first and second fins depending from said respective first and second profiles, sealing one of said first and second fins to said web of plastic film;

folding said fastener away from said web of plastic film about said one of said first and second fins sealed to said web of plastic film;

sealing said first and second fins to each other at selected locations;

removing at least a portion of said first and second tracks and said first and second fins at said selected locations;

mounting a slider at said selected locations onto said first and second tracks; and folding said fastener onto said web of plastic film.

17. The method of claim 16 further including folding said web of plastic film to form two sides of said bags.

18. The method of claim 16 further including forming a tube out of said web of plastic film to form two sides of a bag.

19. The method of claim 16 further including folding said web of plastic film to form two sides of said bags; and sealing the other of said first and second fins to said web of plastic film.

20. The method of claim 16 further including folding said web of plastic film to form two sides of said bags;

sealing the other of said first and second fins to said web of plastic film; and forming side seals in said web of plastic film.

21. The method of claim 16 further including folding said web of plastic film to form two sides of said bags;

sealing the other of said first and second fins to said web of plastic film;

forming side seals in said web of plastic film; and forming separated bags by cutting said web of plastic film along said side seals.

22. A method of applying a slider to a fastener-carrying web of plastic film, comprising:

providing a fastener including first and second interlockable profiles and a fin depending from each of said first and second interlockable profiles;

attaching one of said fins of said fastener to said web of plastic film such that said profiles are immediately adjacent to said web;

folding said attached fastener away from said web such that said profiles are spaced from said web; and applying the slider to said profiles of said folded fastener.

23. The method of claim 22 wherein said step of folding said attached fastener away from said web includes folding said attached fastener about said attached fin.

24. The method of claim 22 wherein said step of folding said attached fastener away from said web includes orienting said profiles generally perpendicular to said web.

25. The method of claim 22 further including folding said fastener back onto said web such that said profiles are immediately adjacent to said web after said step of applying said slider to said profiles.

26. A method of applying a slider to a fastener-carrying web of plastic film, comprising:

providing a fastener including interlockable profiles and fins depending from said respective profiles;

attaching one of said fins to said web of plastic film such that said profiles are immediately adjacent to said web;

folding said fastener away from said web about said attached fin such that said profiles and proximate portions of said fins are oriented at an angle relative to said web; and applying a slider to said profiles of said folded fastener.

27. A method of applying a slider to a fastener, comprising:

providing a fastener including interlockable profiles and fins depending from said respective profiles;

folding said profiles relative to distal portions of said fins such that said profiles are oriented at an angle relative to said distal fin portions;

attaching one of said distal fin portions to a web of plastic film such that said profiles and proximate portions of said fins are oriented at an angle relative to said web; and applying a slider to said profiles of the folded fastener.

28. The method of claim 27 wherein said step of folding said profiles relative to said distal fin portions includes orienting said profiles generally perpendicular to said distal fin portions.

29. The method of claim 27 further including folding said fastener back onto said web such that said profiles are immediately adjacent to said web after said step of applying said slider to said profiles.

* * * * *